US005763128A

United States Patent [19]

Malhotra

[11] Patent Number: 5,763,128

[45] Date of Patent: Jun. 9, 1998

[54] SIMULATED PHOTOGRAPHIC-QUALITY IMAGES ON A SUBSTRATE WITHOUT CURL

[75] Inventor: Shadi L. Malhotra, Mississauga, Canada

[73] Assignee: Xerox Corporation, Stamford, Conn.

[21] Appl. No.: 951,584

[22] Filed: Oct. 16, 1997

[51] Int. Cl.[6] ..... G03G 15/22

[52] U.S. Cl. ..... 430/97; 430/11; 430/126; 430/124

[58] Field of Search ..... 430/11, 97, 126, 430/124

[56] References Cited

U.S. PATENT DOCUMENTS

| | | | |
|---|---|---|---|
| 5,327,201 | 7/1994 | Coleman et al. | 355/200 |
| 5,337,132 | 8/1994 | Cherian | 355/278 |
| 5,418,208 | 5/1995 | Takeda et al. | 503/227 |
| 5,663,023 | 9/1997 | Malhotra | 430/97 |

*Primary Examiner*—John Goodrow

[57] ABSTRACT

Disclosed is an apparatus and method for creating simulated photographic-quality prints, including: (a)providing a coated transparent substrate having a wrong reading toner image formed thereon; (b)providing one surface of a backing substrate with a first coating of a polymeric adhesive binder having a glass transition temperature less than 55° C. an antistatic agent, a lightfastness inducing agent and an optional filler; (c)providing the one surface of the backing substrate with a second coating in contact with the first coating wherein the second coating includes a polymer having a melting point of greater than 50° C.; and a hydroxy functional anticurl agent and a liquid crystalline material; (d)providing another coating on the backing substrate opposite the one surface which has a fragrant aroma, antistatic agent, fire retardant material, and abrasion resistant material; and(e)adhering the substrates to each other by the application of heat and pressure.

20 Claims, 2 Drawing Sheets

SIMULATED PHOTOGRAPHIC-QUALITY IMAGES ON A SUBSTRATE WITHOUT CURL

BACKGROUND OF THE INVENTION

The present invention is directed to creating simulated, photographic-quality prints and substrates suitable for use in creating simulated photographic-quality images. More specifically, the present invention is directed to creating simulated, photographic-quality prints using image receiving transparent substrates such as Mylar™, Cellulose triacetate, polysulfone, polypropylene and the like, bearing a wrong reading image whose quality is enhanced by its lamination to a coated backing substrate comprised of a photographic paper, Teslin™, opaque Mylar® and the like which has a unique repositionable coating on its laminatable side containing a toner wetting agent, an anticurl agent such as a solid hydroxy functional compound and a liquid crystalline compound that has more than one melting transition that reduces the heat generated curl of the laminate and additionally imparts color changes to the laminate on the application of heat. The back side of the laminatable backing sheet coated with an antistatic agent, abrasion resistant, fire resistant, and a material which has a fragrance.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the introduction of the Xerox 5775™ copier/printer, the Xerox 4900™ and the Fuji Xerox A-Color 635™ machine into the market place.

Notwithstanding all the recent development in the area of color printers and copiers there is room for improvement in the quality of color images on paper and synthetic substrates such as Mylar® and Teslin®. The foregoing is particularly true when trying to create photographic-quality images using non photographic processes.

Attempts at improving conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the aforementioned lamination process doesn't produce good results because typically the color toner images at the interface between the laminate and the toner do not make suitable optical contact. That is to say, the initially irregular toner image at the interface is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the appearance of color xerographic images on a transparent substrate comprises refusing the color images. Such a process was observed at a NOMDA trade show in 1985at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate. The refuser was also used during the exhibit for refusing color images on paper.

Following is a discussion of additional prior art which may bear on the patentability of the present invention. In addition to possibly having some relevance to the question of patentability, these references, together with the detailed description to follow, should provide a better understanding and appreciation of the present invention. The prior art discussed herein as well as the prior art cited therein is incorporated herein by reference.

U.S. Pat. Nos. 5,327,201 and 5,337,132 granted to Robert E. Coleman on Jul. 5, 1994 and to Abraham Cherian on Aug. 9, 1994, respectively, disclose the creation of simulated photographic prints using xerography. To this end, reverse reading images are formed on a transparent substrate and backing substrates adhered to the transparent substrate. U.S. patent applications Ser. Nos. 08/095,639, 08/095,622, 08/095,016, 08/095,136 and 08/095,639 cited in the '132 patent are also incorporated herein by reference.

Protective sheets used in various printing and imaging processes are well known. For example, U.S. Pat. No. 5,418,208 (Takeda and Kawashima) discloses a laminated plastic card providing a lamination of a dye accepting layer, a substrate of paper or the like, and a back coat layer on which lamination one or more patterns are printed with a volatile dye, and a transparent plastic film adhered on the lamination by an adhesive agent, wherein the adhesive agent is a saturated polyester having an average molecular weight of 18,000 gm/mole and produced by condensation polymerization of polypropylene glycol or trimethylol propane and adipic acid or azelaic acid.

Other references which may be relevant to the patenability of the present may be found in U.S. Pat. No. 5,663,023 granted to Shadi L. Malhotra on Sep. 2, 1997. The '023 patent as well as the references cited therein are hereby incorporated herein by reference.

BRIEF SUMMARY OF THE INVENTION

The present invention is directed to creating and using coated backing substrates or substrates (FIG. 1) such as opaque Mylar® or the like. The sheets or substrates are utilized in creating simulated photographic-quality prints using imaging procedures such as xerography and ink jet.

Specifically, the present invention is directed to creating simulated, photographicquality prints using image receiving transparent substrates such as Mylar®, Cellulose triacetate, polysulfone, polypropylene and the like, bearing a wrong reading image, print quality being enhanced when adhered to a coated backing substrate derived from photographic paper, Teslin™, opaque Mylar™ and the like which has a unique repositionable coating on its laminatable side containing a toner wetting agent, an anticurl agent and a liquid crystalline compound that has multiple thermal transitions and reduces the heat generated curl of the laminate.

More specifically, the invention is directed to creating simulated photographic-quality prints using image receiving transparent substrates such as Mylar™, Cellulose triacetate, polysulfone, polypropylene and the like, bearing a wrong reading image whose quality is enhanced by its lamination to a coated backing substrate derived from photographic paper, Teslin™, opaque Mylar™ and the like whose image quality is enhanced by their lamination to a coated substrate backing substrate which consists essentially of a substrate such as a coated photographic base paper, a first coating on one side of the substrate consisting of a polymeric binder having a glass transition temperature of less than 55° C., and a second coating in contact with the first coating comprised of at least one material selected from the group consisting of alkylene oxide containing polymers having a melting point of greater than 50° C., and a paper decurling material such as Vitamin E acetate (Aldrich 24,817-7) and a liquid crystalline material having multiple thermal transitions such as more than one melting point, and a third coating on the back side of the substrate comprised of a hydrophobic abrasion resistant polymeric binder, a fragrance producing composition, an antistatic agent, and a fire retardant filler and a light color pigment filler, (b) laminating these substrates at a temperature of about 100° C.to about 150° C. and a pressure of about 75 psi to about 125 psi to an imaged substrate carrying a wrong reading image.

In a specific embodiment, the present invention is directed to (a)coated backing substrates which consist essentially of a substrate, such as a photographic base paper having thereon: a first coating on the first side of the substrate consisting of a polymeric binder having a glass transition temperature of less than 55° C. such as polyvinylmethyl ether, polyethylacrylate and the like and a second coating in contact with the first coating comprised of at least one material selected from the group consisting of alkylene oxide containing polymers such as polyethylene oxide having a melting point of greater than 50° C., and a paper decurling material such as a hydroxy functional compound such as neopentyl glycol propoxylate, (Aldrich # 40,987-1; Aldrich # 41,214-7), glycerol propoxylate, (Aldrich # 37,389-3; Aldrich # 37,390-7; Aldrich # 37,391-5; Aldrich # 37,392-3; Aldrich # 37,396-6; Aldrich # 41,028-4), glycerol propoxylate -b- ethoxylate triol, (Aldrich # 37,386-9; Aldrich # 37,387-7; Aldrich # 37,388-5), glycerol ethoxylate -b-propoxylate triol, (Aldrich # 40,918-9), pentaerythritol ethoxylate, (Aldrich # 41,615-0; # 41,873-0), pentaerythritol propoxylate, (Aldrich # 41,874-9; 41,875-7),pentaerythritol propoxylate/ ethoxylate, (Aldrich # 42,502-8), triethanol amine ethoxylate, (Aldrich # 41,658-4), and a liquid crystalline compound having more than one melting transitions such as cholesteryl nonanoate (Aldrich C7,880-1), 1-isothiocyanato-4-(trans-4-propyl cyclohexyl) benzene (Aldrich 36,629-3),and a third coating on the back side of the substrate comprised of a hydrophobic abrasion resistant polymeric binder such as polycarbonates, polyamides and the like, a fragrance producing compound such as strawberry fragrance producing ethyl maltol, methyl cinnamate, 4-hydroxy-2,5-dimethyl-3(2H)-furanone, ethylmethylphenylglycidate, a fire retardant composition derived from inorganic compounds such as magnesium carbonate, an antistatic agent such as quaternary ammonium salts, and the like and an optional light color pigment filler such as colloidal silica and (b) laminating these substrates at a temperature of about 100° C. to about 150° C. and a pressure of about 75 psi to about 125 psi to an imaged substrate such as transparent Mylar® carrying the wrong reading image.

Other features of the present invention will become apparent as the following description proceeds and upon reference to the drawings, in which:

DETAILED DESCRIPTION OF THE PREFERRED EMBODIMENT OF THE INVENTION

Figure 1:
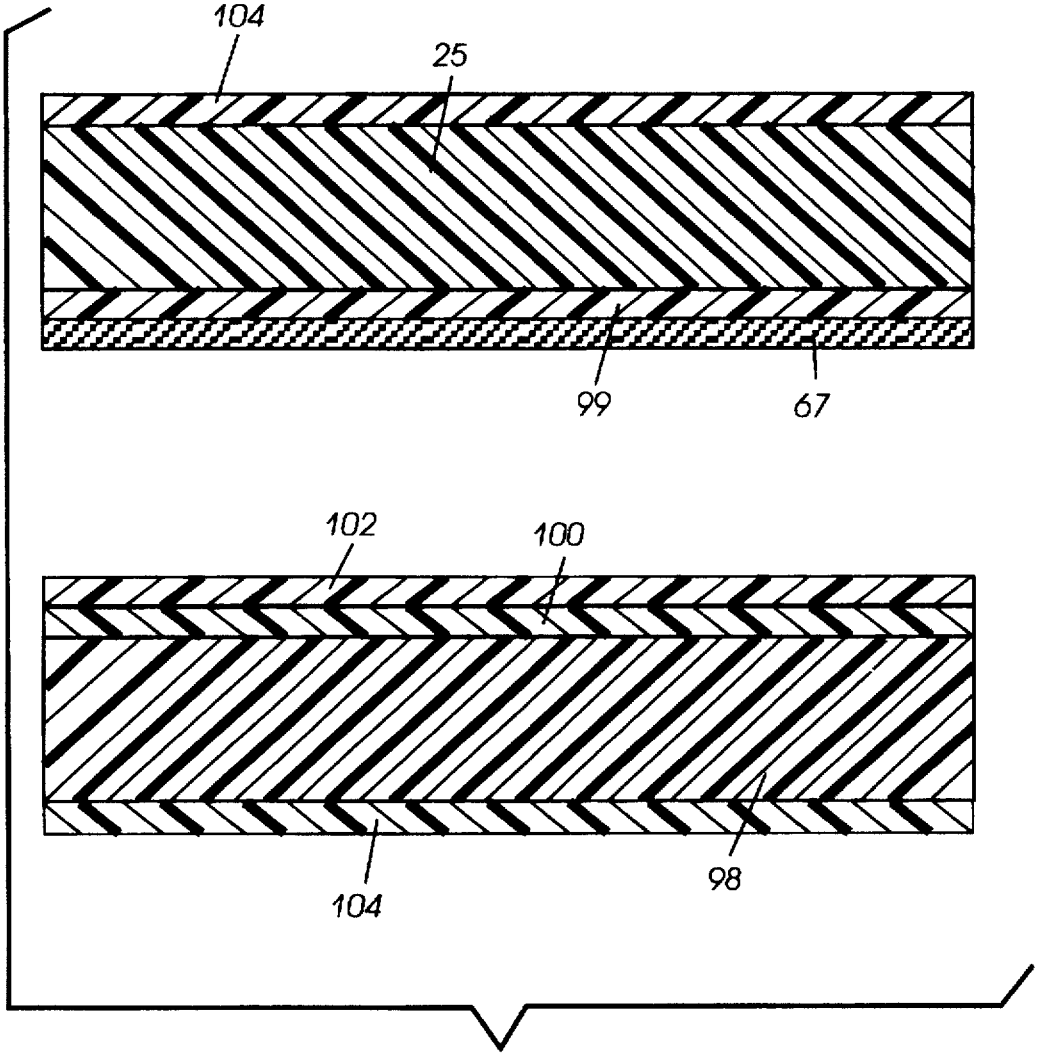
FIG. 1 is a view of a pair of substrates, one a transparency containing a wrong reading image and the other a coated backing substrate containing on one side two layered adhesive coating for adhering backing substrate to an imaged transparency and on the other side a hydrophobic coating which is fire retardant, abrasion resistant, antislip, fragrant and which can be written upon by pen, and pencil.

For a general understanding of the features of the present invention, reference is made to the drawings. In the drawings, like reference numerals have been used throughout to identify identical elements .

While the present invention will hereinafter be described in connection with least one preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

Figure 2:
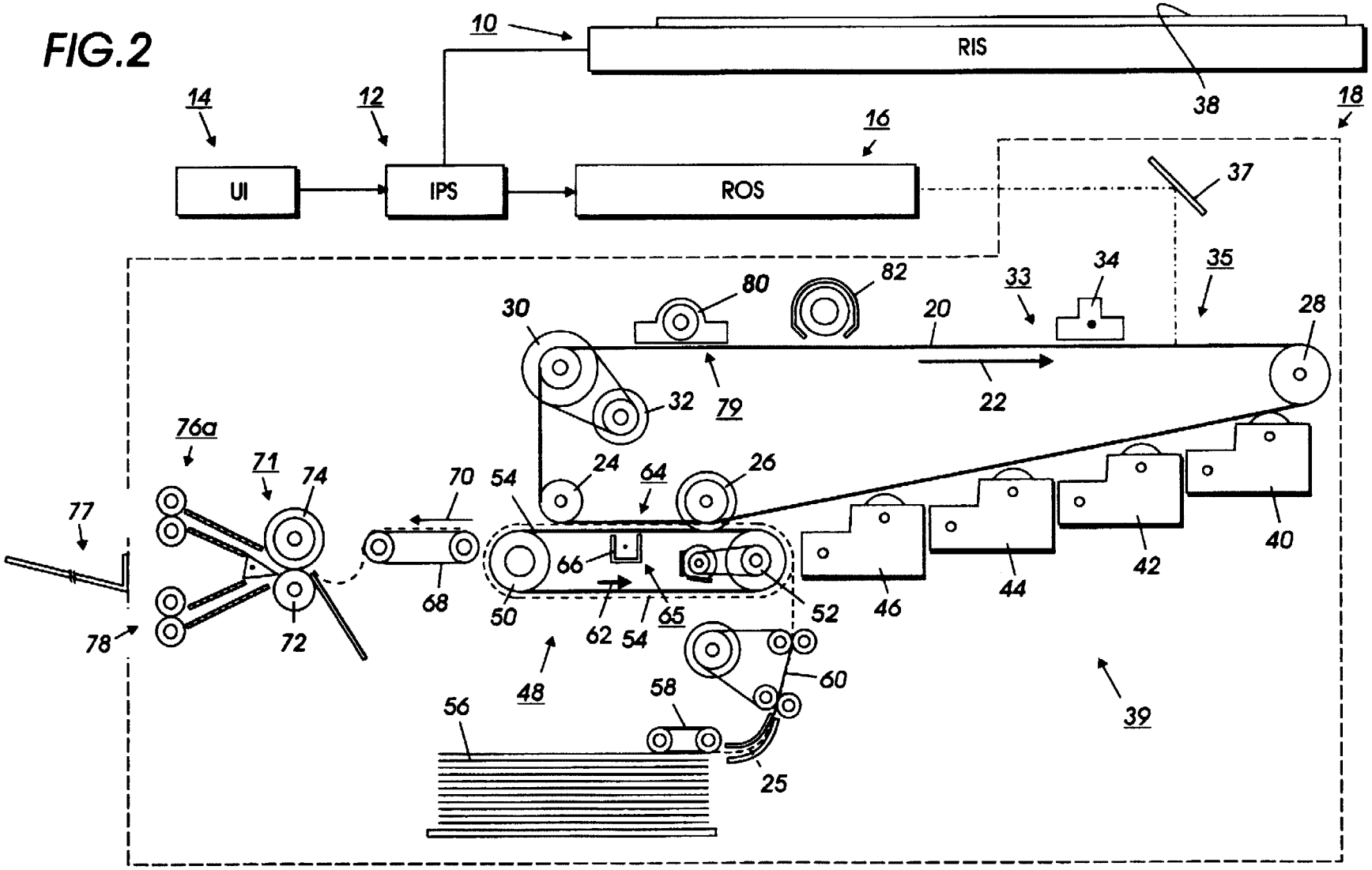
FIG. 2 is a schematic elevational view of an illustrative electrophotographic copier which may be utilized in carrying out the present invention.

Turning initially to FIG. 2, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16 which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right reading toner images on plain paper or mirror images on various other kinds of substrates utilized in the commercially available 5775™ copier. With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color photographic print. It will be appreciated that various other documents may be employed without departing from the scope and true spirit of the invention.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 moves in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image.

Referring again to FIG. 2 one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multicolor facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed. Alternatively, the substrates can be advanced by a pair of rollers **76*a* to a catch tray 77**.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Examples of substantially transparent substrate materials 25 to be imaged upon include polyesters, including Mylar® available from E.I. Du Pont de Nemours & Company, Melinex®, available from Imperial Chemicals, Inc., Celanar®, available from Celanese Corporation, polyethylene naphthalates, such as Kaladex® PEN Films, available from Imperial Chemicals, Inc., polycarbonates such as Lexan®, available from General Electric Company, polysulfones, such as those available from Union Carbide Corporation, polyether sulfones, such as those prepared from 4,4'-diphenyl ether, such as Udel®, available from Union Carbide Corporation, those prepared from disulfonyl chloride, such as Victrex® available from ICI Americas Incorporated, those prepared from biphenylene, such as Astrel®, available from 3M Company, poly (arylene sulfones), such as those prepared from crosslinked poly (arylene ether ketone sulfones), cellulose triacetate, polyvinylchloride cellophane, polyvinyl fluoride, polyimides, and the like, with polyester such as Mylar® being preferred in view of its availability and relatively low cost.

Illustrative examples of backing substrate substrates 98 suitable for the present application include commercially available internally and externally (surface) sized papers include Diazo papers, offset papers such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc, opaque plastics, such as Teslin®, available from PPG Industries, and filled polymers, such as Melinex®, available from ICI. Filled plastics are employed as the substrate, particularly when it is desired to make a "never-tear paper" and the like.

The substrates can be of any effective thickness. Typical thicknesses for the substrate are from about 50to about 500microns, and preferably from about 100to about 125 microns, although the thickness can be outside these ranges.

Each of the substrates 25 and 98 may be provided with one or more coatings for producing enhanced simulated color photographic-quality prints using non photographic imaging processes such as xerography.

The opaque backing substrate 98 of the present invention may carry an adhesive coating 100 on one surface to promote adhesion with the imaged transparent substrate 25.

A second coating 102 applied to the first coating 100 comprises a hydrophilic polymeric binder having a melting point above 50° C. such as poly(ethylene oxide) (POLYOX WSRN-3000, obtained from Union Carbide Company), and a paper decurling hydroxy functional material such as glycerol ethoxylate-b-propoxylate triol, 1-[2-(2-hydroxyethoxy) ethyl]-piperazine, (Aldrich # 33, 126-0),1-4-bis(2-hydroxyethyl)piperazine, (Aldrich # B4, 540-2), homovanillyl alcohol, (Aldrich # 14,883-0), phenethyl alcohol, (Aldrich) # P1,360-6), 3,6-dimethyl-4-octyne-3,6-diol, (Aldrich # 27,840-8),2-(hydroxymethyl)-1,3-propanediol, (Aldrich # 39,365-7),2-butyl-2-ethyl-1,3-propanediol, (Aldrich # 14,247-6),2piperidine) methanol, (Aldrich # 15,522-5), 2,2,4-trimethyl-1,3-pentanediol, (Aldrich # 32,722-0), Vitamin E, (Aldrich # 25,802-4), Vitamin E acetate, (Aldrich # 24,817-7) Vitamin K, (Aldrich # 28,740-7), and a liquid crystalline material having more than one melting transition such as 4'-heptyloxy-4-biphenyl carbonitrile (Aldrich 33,866-4), 1-(trans-4-hexyl) cyclohexyl)-4-isothiocyanato benzene (Aldrich 36,685-4), 4-methoxybenzylidene-4'-n-butylaniline (Aldrich 15,822-4); smectic liquid crystals such as (−) 2-methylbutyl-4-(4'-methoxybenzylidene-amino) cinnamate{CAS # 24140-30-5}, (S)-(+)-2-methylbutyl-4-(4-decyloxy) benzylidene-amino) cinnamate (Aldrich 32,476-6), ethyl 4-ethoxybenzyl-4'-amino cinnamate {CAS # 2863-94-7}, 2-(4-pentylphenyl)-5-(4-pentyloxyphenyl) pyrimidine {CAS # 34913-07-0}, cholesteryl liquid crystals such as cholesteryl-esters.

The purpose of the second coating is to prevent the adhesive binder from being active until it is exposed to heat and pressure. Moreover, the second coating is a wetting agent which effects spreading of the writing materials and reduces heat generated curl when the backing substrate is laminated to the imaged transparency as well as generates different colors under varying conditions of heat pressure, electric or magnetic fields.

The backing substrate carries a third coating 104 that is applied to the opposite side or surface (i.e. the side opposite the side to be adhered to the imaged transparency) of the backing substrate 98 that includes a material which is a blend of a hydrophobic abrasion resistant polymeric binder such as polycarbonates, polyamides and the like, a fragrance producing compound such as coffee fragrance compounds such as furfuryl mercaptan, (Aldrich # F2,040-8),furfuryl thiopropionate, (CAS # 59020-85-8);coconut fragrance compounds such as γ-nonalactone, (CAS # 104-61-0); cognac fragrance compounds such as ethyl oenanthate, (CAS # 106-30-9); fresh fruit fragrance compounds such as 2-methyl-2-pentenoic acid, (Aldrich # 26,477-6); grape and honey fragrance compounds such as methyl anthranilate, (Aldrich # 23,645-4),ethyl 3-hydroxybutyrate, (Aldrich # E3,060-3);grapefruit fragrance compounds such as nootkatone, (CAS # 4674-50-4); hazlenut fragrance compounds such as methyl (methylthio) pyrazine, (CAS # 21948-70-9);jasmine fragrance compounds such as benzyl acetate, (Aldrich # B1,580-5),indole, (Aldrich #26,907-7), cognac fragrance compounds such as ethyl oenanthate, (CAS # 106-30-9); fresh fruit fragrance compounds such as 2-methyl-2-pentenoic acid, (Aldrich # 26,477-6); grape and honey fragrance compounds such as methyl anthranilate, (Aldrich # 23,645-4), ethyl 3-hydroxybutyrate, (Aldrich # E3,060-3);a fire retardant composition derived from inorganic compounds such as neoalkoxy tri (N-ethylaminoethylamino) titanate, available as LICA 44; neoalkoxy trineodecanoyl titanate, available as LICA 01; neoalkoxy dodecylbenzene-sulfonyl titanate, available as LICA 09; neoalkoxy (dioctyl phosphato) titanate, available as LICA 38; all from Kenrich Corporation; silica containing compounds such as semicalcined silica-alumina available as sillum-200; sillum-200Q/P, sillum PL-200; all from D.J. Enterprises; silicone fluid SFR-100, available from G.E. Corporation; and mixtures thereof, an antistatic agent such as quaternary ammonium salts, and the like and a light color pigment filler such as colloidal silica and (b) laminating these sheets at a temperature of about 100° C. to about 150° C. and a pressure of about 75 psi to about 125 psi to an imaged transparent plastic carrying the wrong reading image.

The first coating 100 is present on one side of the substrate used as the coated backing substrate in any effective thickness. Typically, the total thickness of the coating layer is from about 0.1 to about 25 microns and preferably from about 0.5 to 10 microns, although the thickness can be outside of these ranges.

In one embodiment the binder in coating 100 is present in amounts of from about 98.5 percent by weight to about 10 percent by weight although the amounts can be outside of this range. The antistatic agent or mixture thereof are present in the first coating composition in amounts of from about 0.5 percent by weight to about 20 percent by weight although the amounts can be outside of this range. The lightfastness inducing compounds or mixture thereof are present in the first coating in amounts of from about 0.5 percent by weight to about 20 percent by weight although the amounts can be outside of this range. The filler compounds or mixture thereof are present in the first coating in amounts of from about 0.5 percent by weight to about 50 percent by weight although the amounts can be outside of this range.

Examples of suitable adhesive polymers for use as coating 100 for adhering backing substrates to imaged transparent substrates include water dispersible polymers such as those set forth in U.S. patent application Ser. No. 08/720,656filed in the name of Shadi L. Malhotra on Oct. 2, 1996.

In addition, the first coating 100 may contain lightfastness inducing agents including UV absorbing compounds, antioxidant compounds and lightfastness inducing antiozonants such as disclosed in the '656 application.

The second coating 102 in contact with the coating 100 of the substrate used as the backing substrate is present in any effective thickness. Typically, the total thickness of the coating layer is from about 0.1 to about 25 microns and preferably from about 0.5 to 10 microns, although the thickness can be outside of these ranges.

In the second coating composition, the binder can be present within the coating in any effective amount; typically the binder or mixture thereof are present in amounts of from about 99 percent by weight to about 25 percent by weight although the amounts can be outside of this range. In the second coating composition, anticurl agent can be present within the coating in any effective amount; typically the anticurl agents are present in amounts of from about 0.5 percent by weight to about 50 percent by weight although the amounts can be outside of this range, the liquid crystalline material can be present within the coating in any effective amount; typically the liquid crystalline material is present in amounts of from about 0.5 percent by weight to about 25 percent by weight although the amounts can be outside of this range.

Examples of suitable binder polymers for use as coating 102 for preventing premature activation of adhesive polymers comprising the first coating and which serves as a wetting agent include: poly (oxy methylene), such as #009, available from Scientific Polymer Products, poly (oxyethylene) or poly (ethylene oxide), such as POLY OX WSRN-3000, available from Union Carbide Corporation, ethylene oxide/propylene oxide copolymers, such as ethylene oxide/propylene oxide/ethylene oxide triblock copolymer, such as Alkatronic EGE-31-1, available from Alkaril Chemicals, propyleneoxide/ethylene oxide/propyleneoxide triblock copolymers, such as Alkatronic PGP 3B-1, available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8, available from BASF Corporation, ethylene oxide/2-hydroxyethylmethacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobis isobutyronitrile as initiator and reacting the resulting amino-semitelechelic oligo-hydroxyethyl methacrylate or amino-hydroxypropyl methacrylate with an isocyanate-polyethylene oxide complex in chlorobenzene at 0° C. and precipitating the reaction mixture in diethylether, filtering and drying in vacuum, ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor, ionene/ethylene oxide/ionene triblock copolymers, which can be synthesized via quaternization reaction of one end of each 3—3 ionene with the halogenated (preferably brominated) poly (oxyethylene) in methanol at about 40° C. ethylene oxide/isoprene/ethylene oxide triblock copolymers, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, and epichlorohydrin-ethylene oxide copolymer such as #155 available from Scientific Polymer Products as well as mixtures thereof.

The preferred oxyalkylene containing polymers are poly (ethylene oxide), poly (propylene oxide), and ethylene oxide/propylene oxide block copolymers because of their availability and lower cost.

The second layer coating composition 102 in contact with the first layer coating composition 100 also contains anticurl agents selected from the group comprising : trimethylolpropane, (Aldrich # 23,974-7), trimethylolpropane ethoxylate, (Aldrich # 40, 977-4; Aldrich # 40, 978-2; triacrylate, (Aldrich # 24,680-8), trimethylolpropane trimethacrylate, (Aldrich # 24,684-0), trimethylolpropane ethoxylate triacrylate, (Aldrich # 41,217-1; # 41,219-8),) trimethylolpropane propoxylate triacrylate, (Aldrich # 40,756-9; # 40,757-7), trimethylolpropane ethoxylate methylether diacrylate, (Aldrich # 40,587-1), trimethylolpropane tris(2-methyl-1- aziridinepropionate), (Aldrich # 40,544-2), neopentyl glycol ethoxylate, (Aldrich # 41,027-6), neopentyl glycol propoxylate, (Aldrich # 40,987-1; # Aldrich 41,214-7), glycerol propoxylate, (Aldrich # 37,389-3; Aldrich # 37,390-7; Aldrich # 37,391-5; Aldrich # 37,392-3; Aldrich # 37,396-6; Aldrich # 41,028-4), glycerol propoxylate bethoxylate triol, (Aldrich # 37,386-9; Aldrich # 37,387-7; Aldrich # 37,388-5), glycerol ethoxylate -b- propoxylate triol, (Aldrich # 40,918-9), pentaerythritol ethoxylate, (Aldrich # 41,615-0; # 41,873-0), pentaerythritol propoxylate, (Aldrich # 41,874-9; 41,8755-7) pentaerythritol propoxylate/ ethoxylate, (Aldrich # 42,502-8), triethanol amine ethoxylate, (Aldrich # 41,658-4), N-methyl diethanolamine, (Aldrich # M4,220-3), N-ethyl diethanolamine, (Aldrich # 11,206-2), N-butyl diethanolamine, (Aldrich # 12,425-7),Nphenyl diethanolamine, (Aldrich # P2,240-0), triethanol amine, (Aldrich # T5,830-0), trioctylamine, (Aldrich # T8,100-0), 4-xylylene diamine, (Aldrich # 27,963-3), 1,4-bis (2-hydroxyethoxy)-2-butyne, (Aldrich # B4,470-8), pantothenol, (Aldrich # 29,578-7), 1-phenyl-1,2-ethanediol, (Aldrich #30, 215-5; # P2, 405-5), 3-methoxy-1,2-propanediol, (Aldrich # 26,040-1), 3-allyloxy-1,2-propanediol, (Aldrich # 25, 173-9), 3-ethoxy-1,2-propanediol, (Aldrich # 26,042-8), 3-phenoxy-1,2-propanediol, (Aldrich # 25,781-8), 3-octadecyloxy -1,2propanediol, (Aldrich # B40-2),3-(4-methoxy phenoxy) -1,2-propane diol, (Aldrich # 21,024-2), Mephensin [3-(2-methyl phenoxy)-1,2-propanediol], (Aldrich # 21, 849-9), 2-phenyl-1,2-propanediol, (Aldrich #21, 376-4), 3- amino-1,2-propanediol, (Aldrich # A7,600-1),3-(diisopropyl amino)-1,2-propanediol, (Aldrich # 25,766-4), 3-(N-benzyl-N-methylamino)-1,2-propanediol, (Aldrich # 21,850-2), 3-pyrrolidino-1,2-propanediol, (Aldrich # 21, 851-0), 3-piperidino- 1,2-propanediol (Aldrich 21, # 849-9), 3-morpholino-1,2-propanediol, (Aldrich # 21, 848-0), 2,2-dimethyl-1-phenyl-1,3-propane diol, (Aldrich # 40,873-5), 2-benzyloxy-1,3-propanediol, (Aldrich # 36, 744-3), 4-8-bis (hydroxymethyl) tricyclo [5.2.1.02.6] decane, (Aldrich # B4,590-9),1-8 N,N-bis(2-hydroxyethyl) isopropanol amine, (Aldrich # 23,375-7),N,N-Bis(2-hydroxypropyl) ethanolamine, (Karl Industries), 1-[2-(2-hydroxyethoxy) ethyl]-piperazine, (Aldrich # 33, 126-0),1-4-bis(2-hydroxyethyl)piperazine, (Aldrich # B4, 540-2), homovanillyl alcohol, (Aldrich #14,883-0), phenethyl alcohol, (Aldrich # P1,360-6), 3,6-dimethyl-4-octyne-3,6-diol, (Aldrich # 27,840-8),2-(hydroxymethyl)-1,3-propanediol, (Aldrich # 39,3657),2-butyl-2-ethyl-1,3-propanediol, (Aldrich # 14,247-6),2-piperidine methanol, (Aldrich # 15,522-5), 2,2,4-trimethyl-1,3-pentanediol, (Aldrich # 32,722-0),Vitamin E, (Aldrich # 25,802-4),Vitamin E acetate, (Aldrich # 24,817-7) Vitamin K, (Aldrich # 28,740-7), tri (ethylene glycol) dimethylacrylate, (Aldrich # 26,154-8), triethyl citrate, (Aldrich # 10,929-0) 2,4,7,9-tetramethyl-5-decyne-4,7-diol, (Aldrich # 27,838-6); and mixtures thereof.

The second layer coating composition 102 in contact with the first layer coating composition 100 also contains anticurl agents selected from the group comprising (a) Nematic liquid crystalline materials such as those derived from the nitrile group containing compounds such as (1) 4-(trans-4-pentyl cyclohexyl) benzonitrile, (Aldrich # 37,011-8), (2)4'-pentyl-4'-biphenyl carbonitrile (Aldrich 32,851-0), (3)4'-(pentyloxy)-4-biphenylcarbonitrile, (Aldrich # 32,852-9), (4)4'-hexyl-4-biphenyl carbonitrile (Aldrich 33,864-8), (5) 43-(hexyloxy)-4-biphenyl carbonitrile (Aldrich 33,865-6), (6) 4'-heptyl-4-biphenyl carbonitrile (Aldrich 33,081-7), (7) 4'-heptyloxy-4-biphenyl carbonitrile (Aldrich 33,866-4), (8) 4'-octyl-4-biphenyl carbonitrile (Aldrich 33,868-0), (9) 4'-(octyloxy)-4-biphenyl carbonitrile (Aldrich 33,867-2);those derived from the Isothiocyanate and carboxylate group containing compounds such as (1) 1-isothiocyanato-4-(trans-4-propyl cyclohexyl) benzene (Aldrich 36,629-3), (2) 1-(trans-4-hexyl cyclohexyl)-4-isothiocyanato benzene (Aldrich 36,685-4), (3) 1-(4-trans-hexyl cyclohexyl)-4-[2-(4-isothio cyanatophenyl)ethyl] benzene, (Aldrich 37,725-2), (4) 1-isothiocyanato-4-(trans-4-octylcyclohexyl) benzene, (Aldrich # 36,686-2), (5)4-isothiocyanatophenyl-4-penta bicyclo[2.2.2]octane-1-carboxylate, (Aldrich # 37,005-3), (6)(R)-4-[(1-methylheptyl oxy)carbonyl] phenyl 4'-octyloxy-4-biphenyl carboxylate (Aldrich 40,886-7), (7) (S)-4-[(1-methylheptyloxy)carbonyl]phenyl-4'-octyloxy-4-biphenylcarboxylate (Aldrich 40,885-9); those derived from the aniline group containing compounds such as (1) 4-methoxybenzylidene-4'-n-butylaniline (Aldrich 15,822-4) ;(2)4,4'dihexylazoxybenzene, (Aldrich 36,680-3);(3)4,4'-diheptylazoxybenzene, (Aldrich 36,678-1); and the like.

(b) Smectic liquid crystalline materials such as (1) (–) 2-methylbutyl-4-(4'-methoxy benzylidene-amino) cinnamate a noncholesteryl chiral compound { CAS # 24140-30-5}, (2) (S)-(+)-2-methylbutyl-4-(4-decyloxy benzylidene-amino) cinnamate (Aldrich 32,476-6), (3) ethyl 4- ethoxybenzyl-4'-amino cinnamate { CAS # 28 63-94-7}, (4) 2-(4-pentylphenyl)-5-(4-pentyloxyphenyl) pyrimidine ({ CAS # 34913-07-0}; (5)4-[(R)-(–)2-chloro-3-methylbutyryloxy]phenyl-4-(decyloxy) benzoate, (Aldrich 32,854-5); (6)4-[(S)-(+)2-chloro-3-methyl butyryl oxy] phenyl 4-(decyloxy)benzoate, (Aldrich 32,855-3); (7)4-[(S) -(+)- (4-methyl hexyl)oxy]phenyl 4-(decyloxy) benzoate, (Aldrich 32,792-1);(8)4-[(S)-(–)-2-ethoxypropoxy]phenyl 4-(decyloxy) benzoate, (Aldrich 32,792-1), (9)4-hexylbenzoic acid, and the like.

(c) Cholesteryl liquid crystalline materials such as (1) cholesteryl heptanoate (Aldrich C7,780-5), (2) cholesteryl octanoate (Aldrich 12,525-3), (3) cholesteryl nonanoate (Aldrich C7,880-1), (4)cholesteryl palmitate (Aldrich C7,860-7), (5)cholesteryl palmitate (Aldrich C7,860-7), (5) cholesteryl oleyl carbonate (Aldrich 15,115-7), (6)cholesteryl stearate (Aldrich C7,940-9), (7) cholesteryl hydro cinnamate (Aldrich C7,790-2), (8) cholesteryl acetate (Aldrich 15,111-4), (9)cholesteryl chloroformate (Aldrich C7,700-7); and the like The third coating 104 is present on the back side of the substrate used as the coated backing substrate in any effective thickness. Typically, the total thickness of the coating layer is from about 0.1 to about 25 microns and preferably from about 0.5 to 10 microns, although the thickness can be outside of these ranges.

In the third coating composition 104, the binder can be present within the coating in any effective amount; typically the binder or mixture thereof are present in amounts of from about 98 percent by weight to about 20 percent by weight although the amounts can be outside of this range.

The fire retardant compounds or mixture thereof are present in the third coating of the backing substrate in amounts of from about 0.5 percent by weight to about 20 percent by weight although the amounts can be outside of this range.

The antistatic compounds or mixture thereof are present in the third coating of the backing substrate in amounts of from about 0.5 percent by weight to about 20 percent by weight although the amounts can be outside of this range The fragrance producing compounds or mixture thereof are present in the third coating of the backing substrate in amounts of from about 0.5 percent by weight to about 20 percent by weight although the amounts can be outside of this range. The filler compounds or mixture thereof are present in the third coating of the backing substrate in amounts of from about 0.5 percent by weight to about 20 percent by weight although the amounts can be outside of this range.

Examples of suitable polymers for use as coating 104 which is hydrophobic, luminescent, abrasion resistant, antislip, and which can be written upon by pen, pencil and xerography include: poly (vinyl formal), such as #012, available from Scientific Polymer Products, poly (vinyl butyral), such as #043, #511, #507, available from Scientific Polymer Products, vinyl alcohol-vinyl butyral copolymers such as #381, available from Scientific Polymer Products, poly(vinyl acetate) #346, available from Scientific Polymer Products, vinyl alcohol-vinyl acetate copolymers such as #379, available from Scientific Polymer Products, vinyl chloride-vinyl acetate copolymers such as #063, #068, #070, #422 available from Scientific Polymer Products, vinyl chloride-vinyl acetate- vinyl alcohol terpolymers such as #064, #427, #428 available from Scientific Polymer Products, vinyl chloride vinylidene chloride copolymers such as #058, available from Scientific Polymer Products, vinylidene chloride-acrylonitrile copolymers such as #395, #396, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, cellulose propionate such as #2052, available from Scientific Polymer Products, polystyrene such as #039A, #039D, #845, #756 available from Scientific Polymer Products, poly (4-methylstyrene), such as #315, #593,#839, available from Scientific Polymer Products, poly (α-methylstyrene), such as #2055, available from Scientific Polymer Products, poly (tert-butylstyrene), such as #177, available from Scientific Polymer Products, poly (2-chlorostyrene), such as #777, available from Scientific Polymer Products, poly (3-chlorostyrene), such as #778, available from Scientific Polymer Products, poly (4-chlorostyrene), such as #257, available from Scientific Polymer Products, poly (2-bromostyrene), such as #775, available from Scientific Polymer Products, poly (3-bromostyrene), such as #776, available from Scientific Polymer Products, poly (4-bromostyrene), such as #212, available from Scientific Polymer Products, poly (4-methoxy styrene), such as #314, available from Scientific Polymer Products, poly (2,4,6-tribromostyrene), such as #166, available from Scientific Polymer Products, styrenebutylmethacrylate copolymers, such as #595, available from Scientific Polymer Products, styrene - acrylonitrile copolymers, such as #495, available from Scientific Polymer Products, styrene-allyl alcohol copolymers, such as #393,#394 available from Scientific Polymer Products, poly(2-vinyl pyridine) such as #813,#814 available from Scientific Polymer Products, poly(4-vinyl pyridine) such as #700,#840 available from Scientific Polymer Products, poly(2-vinyl pyridine -co-styrene) such as #319, available from Scientific Polymer Products, poly(4-vinyl pyridine-co-styrene) such as #416,#859 available from Scientific Polymer Products, poly(4-vinyl pyridine-co-butylmethacrylate) such as #312,#667, #858, available from Scientific Polymer Products, poly(vinyl toluene) such as #261, available from Scientific Polymer Products, poly(2-vinyl naphthalene) such as #163, available from Scientific Polymer Products, poly(methylmethacrylate) such as #037A, #037B, #037D, #307, #424, #689, available from Scientific Polymer Products, poly(ethyl methacrylate) such as #113, #308, available from Scientific Polymer Products, poly(isopropyl methacrylate) such as #476, available from Scientific Polymer Products, poly(phenyl methacrylate) such as #227, available from Scientific Polymer Products, poly(phenoxy ethyl methacrylate) such as #893, available from Scientific Polymer Products, poly(2-hydroxypropyl methacrylate) such as #232, available from Scientific Polymer Products, polyamide resin such as #385, #386,#387, #388, #389, #390, available from Scientific Polymer Products, poly (p-phenylene ether-sulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, poly carbonates, such as #035, available from Scientific Polymer Products, α-methylstyrene-dimethylsiloxane block copolymers, such as PS 0965, available from Petrarch Systems, dimethyl siloxane-bisphenol A carbonate block copolymers, such as PSO99, available from Petrarch Systems, poly (2,6-dimethyl p-phenylene oxide), such as #126, available from Scientific Polymer Products.

The third layer coating composition 104 in contact with the backside of the laminatable sheet contains fragrance imparting compounds including: apple fragrance compounds such as isoamyl acetate, (Aldrich # 30,696-7), ethyl 2-methylbutyrate, (Aldrich # 30,688-6),n-hexanal, (Aldrich # 11,560-6), rose fragrance compounds such as damascenone, (CAS # 23696-85-7; CAS # 23726-93-4); musk fragrance compounds such as muscone, (CAS # 541-91-3),ethylene brassylate, available as Emmeressence 1150, ethylene dodecanedioate, available as Emmeressence 1151, from Henkel/Emery Corporation; sandlewood fragrance compounds such as eremophilone, (CAS # 562-23-2); anise fragrance compounds such as anethole, (Aldrich # 11,787-0); blueberry fragrance compounds such as isobutyl 2-buteneoate, (CAS # 589-66-2); caramel fragrance compounds such as 2,5-dimethyl-4-hydroxy-3(2H)-furanone, (Aldrich # 32,248-2); caraway and spearmint fragrance compounds such as carvone, (Aldrich # 12,493-1); cherry fragrance compounds such as benzaldehyde, (Aldrich # B,133-4), tolyl aldehyde, (CAS # 23696-85-7),benzyl acetate, (Aldrich # B1,580-5);chocolate fragrance compounds such as 5-methyl-2-phenyl-2-hexenal, (CAS # 21834-92-4), isoamyl butyrate, (CAS # 10627 4), vanilin, (Aldrich # V,110-4),isoamyl phenylacetate, (CAS # 102-192), 2methoxy-5methylpyrazine, (Aldrich # 29,794-1) ;cinnamon fragrance compounds such as cinnamic aldehyde, (Aldrich # 23,996-8),Emmeressence 1166 Styrate, from Henkel/Emery Corporation; aromatic reminiscent of Roman chamomile oil such as Emmeressence 1170 Chamol, from Henkel/Emery Corporation; coffee fragrance compounds such as furfuryl mercaptan, (Aldrich # F2,040-8), furfuryl thiopropionate, (CAS # 59020-85-8); coconut fragrance compounds such as γ- nonalactone, (CAS # 104-61-0); cognac fragrance compounds such as ethyl oenanthate, (CAS # 106-30-9); fresh fruit fragrance compounds such as 2-methyl-2-pentenoic acid, (Aldrich # 26,477-6); grape and honey fragrance compounds such as methyl anthranilate, (Aldrich # 23,645-4),ethyl 3-hydroxybutyrate, (Aldrich # E3,060-3); grapefruit fragrance compounds such as nootkatone, (CAS # 4674-50-4); hazlenut fragrance compounds such as methyl (methylthio) pyrazine, (CAS # 21948-70-9); jasmine fragrance compounds such as benzyl acetate, (Aldrich # B1,580-5), indole, (Aldrich # 26,907-7), Emmeressence 1171 Pseudojasmone, Emmeressence 1173 Parajasmone, from Henkel/Emery Corporation; lime and lemon fragrance compounds such as citral, (Aldrich # C8,300-7), α-terpineol, (Aldrich # 21,837-5); mandarin orange, tangerine fragrance compounds such as β-sinensal, (CAS # 8028-48-6), dimethyl anthranilate, (CAS # 85-91-6), thymol, (Aldrich # 11,209-7), octyl aldehyde, (Aldrich # 0,5608), decyl aldehyde, (Aldrich # 12,577-6); melon fragrance compounds such as 2-methyl-3-ptolylpropionaldehyde, (CAS # 16251-78-8),hydroxy citronellal dimethylacetal, (CAS # 14192 4), 2,6dimethyl-5heptenal, (CAS # 106-72-9), 2-phenyl propionaldehyde, (Aldrich # 24,136-9), 2-methyl-3-(4-isopropylphenyl) propionaldehyde; maple fragrance compounds such as 3-methyl-1,2-cyclopentanedione, (Aldrich # 17,850-0); peppermint and mint fragrance compounds such as menthol, (Aldrich # M,277-2); passion fruit fragrance compounds such as 3-methylthio-1-hexanol, (Aldrich # 30,374-7); peach fragrance compounds such as γ-undecalactone, (Aldrich # U,80-6), 6-amyl-α-pyrone, (CAS # 27593-23-3); peanut fragrance compounds such as 2,5-dimethylpyrazine, (Aldrich # 17,542-0); pear fragrance compounds such as ethyl decane-cis-4-trans-2-dienoate, (CAS # 3025-30-7); pineapple fragrance compounds such as allyl caproate, (CAS # 123-68-2),methyl- β-methyl thio propio- nate, (Aldrich # 10,337-3), allyl cyclohexanepropionate, (Aldrich # 41,165-5); raspberry fragrance compounds such as 6-methyl-α-ionone, (CAS # 79696), trans-α-ionone, (CAS # 127-41-3), 4-(4-hydroxyphenyl)-2-butanone, (Aldrich # 17,851-9); strawberry fragrance compounds such as ethyl maltol, (CAS # 4940-11-8), methyl cinnamate, (Aldrich # 17,328-2), 4-hydroxy-2,5dimethyl-3(2H)-furanone, (Aldrich # 32,248 2), ethylmethylphenylglycidate, (CAS # 77-83-8); vanilla fragrance compounds such as ethyl vanilin, (Aldrich # 12,809-0),propenyl quaethol, (CAS # 94-86-0); aromatic with odor reminiscent of freshly cut privet hedge such as Emmeressence 1172 Privetone, from Henkel/Emery Corporation; aromatic with sweet balsamic odor reminiscent of Canadian Fir such as Emmeressence 1174 Fir Balsam, from Henkel/Emery Corporation; polytrap 223, polytrap 227, polytrap 228, containing floral fragrance in a hydrophobic matrix available from Dow Corning/Wickhen Company; and mixtures thereof.

In addition, the third coating 104 may contain antistatic agents. Suitable antistatic agents include both anionic and cationic materials. Monoester sulfosuccinates, diester sulfosuccinates and sulfosuccinamates are anionic antistatic components which have been found suitable for use in the present coatings. Suitable cationic antistatic components comprise diamino alkanes; quaternary salts; quaternary acrylic copolymer latexes such as HX-42-1, HX-42-3 available from Inter Polymer Corporation; ammonium quaternary salts as disclosed in U.S. Pat. No. 5,320,902 (Malhotra et al); phosphonium quaternary salts as disclosed in Copending application U.S. application Ser. No. 08/034,917 (Attorney Docket No. D/92586); and sulfonium, thiazolium and benzothiazolium quaternary salts as disclosed in U.S. Pat. No. 5,314,747 (Malhotra and Bryant)

In addition, the third coating 104 may contain fillers, fire retardant compounds and pigments.

Examples of filler components include zirconium oxide (SF-EXTRA available from Z-Tech Corporation), colloidal silicas, such as Syloid 74, available from Grace Company (preferably present, in one embodiment, in an amount of from about 10 to about 70 percent by weight percent), titanium dioxide (available as Rutile or Anatase from NL Chem Canada, Inc), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blend of calcium fluoride and silica, such as Opalex-C available from Kemira.O.Y. zinc oxide, such as Zoco Fax 183, available from Zo Chem, blends of zinc sulfide with barium sulfate, such as Lithopane, available from Schteben Company. Brightener pigments can enhance color mixing and assist in improving print-through in the imaging substrates of the present invention. Commercially sold pigment colors are dispersed in polymers such as polyamide or Triazine-aldehydeamide and are available from Day-Glo Color Corp such as Day-Glo-A-Series including A-17-N saturn yellow; A-18-N signal yellow; A-16-N arc yellow; A-15-N blaze orange; A-14-N fire orange; A-13-N rocket red; A-12 neon red; A-11 aurora pink; A-21 corona magenta; A19 horizon blue; also included are materials from the Day-Glo-D -Series; Day-Glo-T-Series; Day-Glo-AX-Series; Day-Glo-SB-Series; Day-Glo-HM-Series; Day-glo-HMS -Series; those dispersed in polyester or Triazine-aldehyde-amide are available from Radiant Color Corp. including Radiant R-105 - Series; including R-105 -810 chartreuse; R-105 -811 green; R-105 -812 orange - yellow; R-105 -813 orange; R-105 -814 orange - red; R -105 -815 red; R-105 -816 cerise; R-105 -817 pink; R-103 - G-118 magenta; R-103 - G-119 blue; also included are materials from the R-203 - G-series; R- P- 1600- series; R- P-1700-series; R- XRB- series; R - K-500 series; and visiprint - series; those dispersed in Triazine-aldehyde-amide are available from Lawter Chemicals including Lawter-B-Series including B-3539 lemon yellow; B-3545 green; B-3515 gold yellow; B-3514 yellow orange; B-3513 red orange; B-3534 red; B-3530 cerise red; B-3522 pink; B-3554 magenta; B-3556 vivid blue; also included are materials from the Lawter-G-3000-Series; Lawter-HVT-Series; are very suitable for the present application. Inorganic powder phosphors, polymer dispersed organic pigment phosphors as well as monomeric or polymeric dye based phosphors can be applied to various substrates via solvent coatings where the phosphor is compounded with a polymer and dispersed or dissolved in a solvent such as ethanol, esters, ketones, glycol ethers and water. The use of solvents such as ethanol and water is preferred because these are less toxic.

Examples of fire retardant fillers include magnesium carbonate, available as Elastocarb Tech Light, Elastocarb Tech High from Morton International Corporation; magnesium hydroxide, available as Versamag B-16, Versamag DC, Versamag SB, Versamag UF, from Morton International Corporation, available as FR-20, from Dead Sea Bromine Corporation, available as Kisuma 5A, Kisuma 5B, Kisuma 5E, from Kyowa Corporation; antimony oxide, available as Harshaw-HFR-201, Harshaw-KR, Harshaw-HFR301, from M&T Harshaw corporation, available as Thermoguard L, Thermoguard S, Thermoguard CPA, available as Nyacol A-1530, Nyacol A-1540N, Nyacol A-1550, Nyacol A-1588 LP, Nyacol AB-40, Nyacol AGO-40, Nyacol AP-50, Nyacol APE-1540, Nyacol APVC-40, Nyacol HA-15, Nyacol N-22, Nyacol N-24, Nyacol ZTA; zinc borate, available as Firebrake ZB, from U.S. Borax Corporation; alumina trihydrate, available as Haltex 300, Haltex 310, Haltex 313, Haltex 320, from Hitox Corporation, available as Micral 532, Micral 855, Micral 916, Micral 932, FRE, SB-136, SB-331, SB-332, SB-335, SB-336, SB-431, SB-432, SB-632, SB-805, SB-932, from Solem Corporation; titanium base compounds such as alkoxy triacryl titanate, available as Ken-React 39DS, from Kenrich Corporation; neoalkoxy tri (N-ethylaminoethylamino) titanate, available as LICA 44; neoalkoxy trineodecanoyl titanate, available as LICA 01; neoalkoxy dodecylbenzene-sulfonyl titanate, available as LICA 09; neoalkoxy (dioctyl phosphato) titanate, available as LICA 38; all from Kenrich Corporation; silica containing compounds such as semicalcined silica-alumina available as sillum-200; sillum-200Q/P, sillum PL-200; all from D.J. Enterprises; silicone fluid SFR-100, available from G.E. Corporation; and mixtures thereof.

In one embodiment the third coating in contact with the back of the backing substrate is comprised of from about 88.5 percent by weight to about 10 percent by weight of the binder or mixture thereof, from about 0.5 percent by weight to about 10 percent by weight of the antistatic agent or mixture thereof, from about 0.5 percent by weight to about 30 percent by weight of the fragrance producing compound or mixture thereof, from about 0.5 percent by weight to about 20 percent by weight of the fire retardant material or mixture thereof and from about 10 percent by weight to about 30 percent by weight of the filler or mixture thereof.

The coating compositions discussed above can be applied to the substrate by any suitable technique. For example, the coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25° to about 100° C. in an air drier.

Laminated imaged substrates of the present invention exhibit reduced curl upon being printed with aqueous inks. Generally, the term "curl" refers to the distance between the base line of the arc formed by the imaged substrate when viewed in cross-section across its width (or shorter dimension—for example, 8.5 inches in an 8.5 by 11 inch sheet, as opposed to length, or longer dimension—for example, 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The gloss values recited herein were obtained on a 75° Glossmeter, Glossgard II from Pacific Scientific (Gardner /Neotec Instrument Division).

The optical density measurements recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of the coating 104 which is hydrophobic, fire and abrasion resistant, fragrant, and which can be written upon by pen, and pencil:

Twenty coated backing substrates were prepared by the solvent extrusion process on a Faustel Coater using a one slot die, by providing for each a photographic paper base sheet (roll form) with a thickness of 112 microns such as C-654 Scholler Graphic Papers available from Scholler Technical Papers Incorporated, with a coating 104 comprised of 60 percent by weight polyester latex Eastman AQ 29D available from Eastman Chemical Company, 5.0 percent by weight of the antistatic agent Alkasurf SS-L7DE available from Alkaril Chemicals, 3.0 percent by weight of poly[N,N-bis(2,2,6,6-tetramethyl-4-piperidinyl) 1,6-hexanediamine-co-2,4-dichloro-6-morpholino-1,3,5-triazine) (Cyasorb UV-3346, # 41,324-0, available from Aldrich chemical company) and 2.0 percent by weight of didodecyl-3,3'-thiodipropionate, 10 percent by weight of passion fruit fragrance compound 3-methylthio-1-hexanol, (Aldrich # 30,374-7), 10 percent by weight of colloidal silica, Syloid 74, available from Grace Company, 10 percent by weight of fire retardant magnesium carbonate, available as Elastocarb Tech High from Morton International Corporation which composition was present in a concentration of 35 percent by weight in water. Subsequent to air drying at 100° C.and monitoring the difference in weight prior to and subsequent to coating, the dried photographic paper base rolls contained 1 gram, 10 microns in thickness, of the polyester base coating 104.

Preparation of two layered adhesive coating 100/102 for adhering backing substrates to imaged transparent substrates:

Rewinding the coated Scholler Graphic Papers on an empty core, the uncoated side of paper were further coated simultaneously with two polymeric layers where the layer 100 in contact with the substrate was comprised of a blend of 90 percent by weight acrylic emulsion latex, Rhoplex B-15J, from Rohm and Haas Company, 5.0 percent by weight of the antistatic agent Alkasurf SS-0-75, available from Alkaril Chemicals, 3.0 percent by weight of the UV absorbing compound poly[N,N-bis (2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound triethyleneglycol-bis [3-(3'-tert-butyl-4'-hydroxy-5'-methylphenyl) propi-onate], available as Irganox 245, from Ciba-Geigy Corporation, which composition was present in a concentration of 35 percent by weight in water and the layer 102 in contact with the layer 100 was poly (ethylene oxide) (POLYOX WSRN-3000, obtained from Union Carbide Company) having excellent image-wetting properties present in an amount of 50 present by weight and an anticurl agent glycerol ethoxylate -b- propoxylate triol (Aldrich 40,918-9), 30 percent by weight and cholesteryl liquid crystalline material cholesteryl nonanoate (Aldrich C7,880-1), 20 percent by weight, which mixture was present in a concentration of 5 percent by weight in water. Subsequent to air drying the two layers simultaneously at 100° C. and monitoring the difference in weight prior to and subsequent to coating, the dried Scholler Graphic Papers contained 1.5 gram, 15 microns in thickness, of Rhoplex B-15J containing composition overcoated with poly(ethylene oxide), cholesteryl nonanoate and the anticurl agent glycerol ethoxylate-b-propoxylate triol. The coated Scholler Graphic Papers were cut from this roll in sizes of 8.5 by 11.0 inch cut sheets.

Preparation of the xerographic images on transparent substrate 25 such as Mylar®:

20 sheets of commercially available Fuji Xerox COLOR OHP Transparency were fed into a Xerox 5760™ color copier and wrong reading images were obtained having optical density values of 1.25 (cyan), 1.10 (magenta), 0.75 (yellow) and 1.40 (black).

Lamination of imaged transparencies with the coated backing substrates containing coating 100/102:

The imaged side of the transparency carrying the wrong reading image was brought in contact with the heat and pressure sensitive material coated side of the coated Scholler Graphic Papers and laminated at 150° C. and a pressure of 100 psi for 2 minutes in a Model 7000 Laminator from Southwest Binding Systems, Ontario, Canada. The laminated structure of imaged transparent Mylar® and photographic paper base had a gloss of 130 units, and optical density values of 1.37 (cyan), 1.23 (magenta), 0.87 (yellow) and 1.54 (black). These images were waterfast when washed with water for 2 minutes at 50° C. and lightfast for a period of three months without any change in their optical density. The laminated structure of imaged transparent Mylar® and photographic base paper had a hanging curl value of 10 mm [hanging curl value without the decurling agent is 75 mm], had a visual defect value of 5 compared to a defect value of 40 without a decurling agent [20 defects[such as air pockets] per page constitute 100 defect value].

EXAMPLE II

Preparation of the coating 104 which is hydrophobic, luminescent, abrasion resistant, antislip, and which can be written upon by pen, and pencil:

Twenty coated backing substrates were prepared by the solvent extrusion process on a Faustel Coater using a one slot die, by providing for each a photographic paper base sheet (roll form) with a thickness of 112 microns such as C-654 Scholler Graphic Papers available from Scholler Technical Papers Incorporated, with a coating 104 comprised of 60 percent by weight polyester latex Eastman AQ 29D available from Eastman Chemical Company, 5.0 percent by weight of the antistatic agent 2-methyl-3-propyl benzothiazolium iodide Aldrich 36,329-4), 3 percent by weight of UV absorbing compound poly[2-(4-benzoyl-3-hydroxyphenoxy)ethylacrylate](Cyasorb UV-2126, # 41,323-2, available from Aldrich chemical company), 2 percent by weight of an antioxidant compound oxysulfide dithio carbamate, available as Vanlube 622, from Vanderbilt Corporation, 10 percent by weight of lime and lemon fragrance compound citral, (Aldrich # C8,300-7), 10 percent by weight of colloidal silica, Syloid 74, available from Grace Company, 10 percent by weight of fire retardant neoalkoxy tri (N-ethylaminoethylamino) titanate, available as LICA 44, which composition was present in a concentration of 35 percent by weight in water. Subsequent to air drying at 100° C. and monitoring the difference in weight prior to and subsequent to coating, the dried photographic paper base rolls contained 1 gram, 10 microns in thickness, of the polyester base coating 104.

Preparation of two layered adhesive coating 100/102 for adhering backing substrates to imaged transparent substrates:

Rewinding the coated Scholler Graphic Papers on an empty core, the uncoated side of paper were further coated simultaneously with two polymeric layers where the layer 100 in contact with the substrate was comprised of a blend of 90 percent by weight of poly(2-ethylhexyl methacrylate), such as #229, available from Scientific Polymer Products, 5 percent by weight of the antistat 2-methyl-3-propyl benzothiazolium iodide Aldrich 36,329-4), 3 percent by weight of UV absorbing compound poly[2-(4-benzoyl-3-hydroxyphenoxy) ethyl acrylate] (Cyasorb UV-2126, #41, 323-2, available from Aldrich chemical company),and 2 percent by weight of an antioxidant compound 2,2'-ethylidene- bis(4,6-ditert-butyl phenyl)fluorophosphonite, available as Ethanox 398, from Ethyl Corporation, present in a concentration of 10 percent by weight in toluene. The layer 102 in contact with the layer 100 was a polymer having excellent image-wetting properties such as epichlorohydrin-ethylene oxide copolymer such as #155 available from Scientific Polymer Products 50 present by weight, a cholesteryl liquid crystalline material cholesteryl oleyl carbonate (Aldrich 15,115-7) 20 percent by weight and an anticurl agent Vitamin E acetate (Aldrich 24,817-7) 30 percent by weight which blend was present in a concentration of 4 percent by weight in toluene. Subsequent to air drying the two layers simultaneously at 100° C. and monitoring the difference in weight prior to and subsequent to coating, the dried photographic paper base rolls contained 1.5 gram, 15 microns in thickness, of poly(2-ethylhexyl methacrylate) overcoated with a blend of epichlorohydrin-ethyleneoxide copolymer, cholesteryl oleyl carbonate and the anticurl agent Vitamin E acetate. The coated backing substrates were cut from this roll in 8.5 by 11.0 inch cut sheets.

Preparation of the ink jet ink images on transparent substrate 25 containing coating 99:

Transparencies containing hydrophilic ink receiving layers were prepared as follows as described in a copending application U.S. Ser. No. (not yet assigned); Attorney Docket No. D/93601), with the named inventor Shadi L. Malhotra, entitled "Recording Sheets containing Oxazole, Isooxazole, Oxazolidinone, Oxazoline Salt, Morpholine, Thiazole, Thiazolidine, Thiadiazole, and Phenothiazine Compounds" the disclosure of which is totally incorporated herein by reference. Blends of 54 percent by weight hydroxypropyl methyl cellulose (K35LV, obtained from Dow Chemical Co), 36 percent by weight poly(ethylene oxide) (POLY OX WSRN-3000, obtained from Union Carbide Corp., and 10 percent by weight of additive 4-morpholine propane sulfonic acid obtained from Aldrich Chemical Co., were prepared by mixing 43.2 grams of hydroxypropyl methyl cellulose, 28.8 grams of poly(ethylene oxide), and 8 grams of the 4-morpholine propane sulfonic acid in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5 by 11 inches) in a thickness of 100 microns. Subsequent to air drying at 25° C. for 3 hours followed by oven drying at 100° C. for 10 minutes and monitoring the difference in weight prior to and subsequent to coating, the dried coated transparencies contained 1 gram, 10 microns in thickness of the ink receiving layers, on each surface (2 grams total coating weight for 2-sided transparency) of the substrate.

The transparencies thus prepared were incorporated into a color ink jet printer equipped with wrong reading image writing capability and containing inks of the following compositions:

Cyan: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co), 35 percent by weight Projet Cyan 1 dye, obtained from ICI, 34.285 percent by weight deionized water.

Magenta: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl) aminomethane obtained from Aldrich Chemical company, 0.35 percent by weight EDTA(ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co), 25 percent by weight Projet magenta 1T dye, obtained from ICI, 4.3 percent by weight Acid Red 52 obtained from Tricon Colors, 39.985 percent by weight deionized water.

Yellow: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co), 27.0 percent by weight Projet yellow 1G dye, obtained from ICI, 20.0 percent by weight Acid yellow 17 obtained from Tricon Colors, 22.285 percent by weight deionized water.

Images were generated having optical density values of 1.40 (cyan),1.17 (magenta),0.80 (yellow) and 1.75 (black).

Lamination of imaged transparency with the backing substrate containing coating 100/102.

The imaged side of the transparency was brought in contact with the heat and pressure sensitive adhesive side of the coated backing substrate and laminated together at 150° C. and a pressure of 100 psi for 2 minutes in a Model 7000 Laminator from Southwest Binding Systems, Ontario, Canada. The laminated structure of transparent Mylar and opaque paper had a gloss of 125 units, and optical density values of 1.47 (cyan), 1.25 (magenta), 0.90 (yellow) and 1.90 (black). These images were waterfast when washed with water for 2 minutes at 50° C. and lightfast for a period of three months without any change in their optical density. The laminated structure of imaged transparent Mylar® and photographic base paper had a hanging curl value of 15 mm [hanging curl value without the decurling agent is 75 mm], had a visual defect value of 5 compared to a defect value of 40 without a decurling agent [20 defects[such as air pockets] per page constitute 100 defect value].

EXAMPLE III

Preparation of the coating 104 which is hydrophobic, luminescent, abrasion resistant, antislip, and which can be written upon by pen, and pencil.

Twenty coated backing substrates were prepared by the solvent extrusion process on a Faustel Coater using a one slot die, by providing for each opaque Mylar™ sheets (roll form) with a thickness of 100 microns with a coating 104 comprised of 75 percent by weight of poly (α-methylstyrene), 10 percent by weight of a fluorescent pigment Radiant R-103-G-818 magenta, 5 percent by weight of the antistat 2-methyl-3-propyl benzothiazolium iodide Aldrich 36,329-4),3 percent by weight of UV absorbing compound poly[2-(4-benzoyl-3-hydroxyphenoxy) ethylacrylate](Cyasorb UV-2126, #41,323-2, available from Aldrich chemical company), 2 percent by weight of an antioxidant compound oxysulfide dithio carbamate, available as Vaniube 622, from Vanderbilt Corporation, and 10 percent by weight of vanilin, (Aldrich # V,110-4),10 percent by weight of the fire retardant zinc borate, available as Firebrake ZB, from U.S. Borax Corporation, which blend was present in a concentration of 10 percent by weight in acetone. Subsequent to air drying at 100° C. and monitoring the difference in weight prior to and subsequent to coating, the dried opaque Mylar™ rolls contained 0.5 gram, 5 microns in thickness, of the scuff resistant, fire retardant, fragrant and high gloss coating 104.

Preparation of two layered adhesive coating 100/102 for adhering backing substrates to imaged transparent substrates:

Rewinding the opaque Mylar™ (roll form) containing coating 104 on to an empty core and using these rolls, the uncoated side of the polyester Mylar were coated with a heat and pressure sensitive coating combination 100/ 102. This two layered 100/102 coating structure was prepared by the solvent extrusion process on a Faustel Coater using a two slot die, and coating the base sheet simultaneously with two polymeric layers where the layer 100 in contact with the substrate was comprised of a blend containing 90 percent by weight of poly(2-ethylhexyl methacrylate), such as #229, available from Scientific Polymer Products, 5 percent by weight of the antistat 2-methyl-3-propyl benzothiazolium iodide Aldrich 36,329-4),3 percent by weight of UV absorbing compound poly[2-(4-benzoyl-3-hydroxyphenoxy) ethylacrylate] (Cyasorb UV-2126, #41,323-2, available from Aldrich chemical company),and 2 percent by weight of an antioxidant compound tris(4-tert-butyl-3-hydroxy-2,6-dimethylbenzyl)isocyan-urate, available as Cyanox UV-1790, #41,322-4, from Aldrich chemical company, present in a concentration of 10 percent by weight in toluene. The layer 102 in contact with the layer 100 was a polymer epichlorohydrin-ethylene oxide copolymer #155 available from Scientific Polymer Products having excellent image-wetting properties present in an amount of 50 percent by weight, an anticurl agent trimethylolpropane tris(2-methyl-1-aziridine propionate) (Aldrich 40,544-2),30 percent by weight and a liquid crystalline material 1-isothiocyanato-4-(trans-4-propyl cyclohexyl) benzene (Aldrich 36,629-3),20 percent by weight which blend was present in a concentration of 10 percent by weight in toluene. Subsequent to air drying the two layers simultaneously at 100° C. and monitoring the difference in weight prior to and subsequent to coating, the dried opaque polyester Mylar™ rolls contained 1.5 gram, 15 microns in thickness, of poly(2-ethylhexyl methacrylate) overcoated with a blend of epichlorohydrinethyleneoxide copolymer, liquid crystalline material 1-isothiocyanato-4-(trans-4-propyl cyclohexyl) benzene and trimethylolpropane tris (2-methyl-1-aziridine propionate). The coated backing substrates were cut from this roll in 8.5 by 11.0 inch cut sheets.

Preparation of xerographic images on transparent substrate 25 containing coating 99:

Transparencies were prepared by a dip coating process (both sides coated in one operation) by providing Mylar™ (8.5 by 11 inches) in a thickness of 100 microns and coating them with blend comprised of 80 percent by weight of a binder resin, polyester latex (Eastman AQ 29D), 18 percent by weight of (±)-62 ,β-dimethyl-65 -(hydroxymethyl)-65 -butyrolactone (Aldrich 26,496-2),1 percent by weight of D,L-carnitinamide hydrochloride (Aldrich 24,783-9), and 1 percent by weight of the traction agent colloidal silica, Syloid 74, obtained from W. R. Grace & Co., which blend was present in water solution in a concentration of 25 percent by weight, as described in the U.S. Pat. No. 5,451, 458 with the named inventor Shadi L. Malhotra, entitled "Recording Sheets" the disclosure of which is totally incorporated herein by reference. The coated Mylar™ transparencies were then dried in a vacuum hood for one hour. Measuring the difference in weight prior to and subsequent to coating these transparencies indicated an average coating weight of about 300 milligrams on each side in a thickness of about 3 microns. Twenty of these transparencies were fed into a Xerox 5770 ™ color copier and images were obtained having optical density values of 1.35 (cyan), 1.23 (magenta), 0.89 (yellow) and 1.58 (black).

Lamination of images on transparency with the coated backing substrate containing coating 100/102:

The imaged side of the transparency was brought in contact with the heat and pressure sensitive side of the coated backing substrate and laminated thereto at 140° C. and a pressure of 100 psi for 2 minutes in a Model 7000 Laminator from Southwest Binding Systems, Ontario, Canada. The laminated structure of transparent polyester Mylar™ with opaque Mylar™ had a gloss of 140 units, and had optical density values of 1.35 (cyan), 1.23 (magenta), 0.89 (yellow) and 1.58 (black).The side of the laminated structure containing coating 104 were non-slippery, robust without any finger print marks and could be written upon by pen and pencil. The laminated structure of imaged transparent Mylar® and photographic base paper had a hanging curl value of 5 mm [hanging curl value without the decurling agent is 75 mm], had a visual defect value of 0 compared to a defect value of 40 without a decurling agent [20 defects [such as air pockets] per page constitute 100 defect value].

Other embodiments and modifications of the present invention may occur to those skilled in the art subsequent to a review of the information presented herein, these embodiments and modifications, as well as equivalents thereof, are also included within the scope of this invention.

What is claimed is:

1. A method of creating simulated photographic-quality prints, said method including the steps of:

providing a coated transparent substrate having a wrong reading toner image formed thereon using a non-photographic imaging process;

providing one surface of a backing substrate with a first coating comprising a polymeric adhesive binder having a glass transition temperature less than 55° C. an antistatic agent, a lightfastness inducing agent and an optional filler;

providing said one surface of said backing substrate with a second coating in contact with said first coating wherein said second coating comprises a polymer having a melting point of greater than 50° C. and a hydroxy functional anticurl agent;

adhering said substrates to each other at a temperature of about 100° C. to about 150° C. and a pressure of about 75 psi to about 125 psi.

2. The method according to claim 1 wherein said second coating further comprises a material having multiple thermal transitions.

3. The method according to claim 2 including the step of providing a third coating containing a fragrance producing material.

4. The method according to claim 3 wherein said third coating further comprises a fire retardant material.

5. The method according to claim 4 wherein said first coating includes a light fastness inducing agent selected from the group consisting of: (1) 2-(4-benzoyl-3-hydroxyphenoxy)ethylacrylate), (2) 1,2-hydroxy-4-(octyloxy)benzo-phenone, (3)poly[2-(4 -benzoyl-3-hydroxy-phenoxy)-ethylacrylate], (4) hexadecyl-3,5-di-tert-butyl-4-hydroxybenzoate, (5) poly(N,N-bis(2,2,6,6-tetramethyl-4-piperi-dinyl)-1,6-hexanediamine-co-2,4-dichloro-6-morpholino-1,3,5-triazine), (6) 2-do-decyl-N-(2,2,6,6-tetramethyl-4-piperidinyl)succinimide, (7) 2-dodecyl-N-(1,2,2,6,6-pentamethyl-4-piperidinyl)succinimide, (8) N-(1-acetyl-2,2,6,6-tetramethyl-4-piperidinyl)-2-dodecylsuccinimide, (9) 1-(N-8 poly(3-allyloxy-2-hydroxypropyl)-2-aminoethyl]-2-imidazolidinone, (10) 2,2'-methylenebis-(6-tert-butyl-4-methyl-phenol), (11) 2,2'-methyl-enebis(6-tert-butyl-4-ethylphenol), (12) tris(4-tert-butyl-3-hydroxy-2,6-dimethyl-benzyl)isocyanurate, (13) didodecyl-3,3'-thiodipropionate, (14) ditridecyl-3,3'-thiodipropionate, (15) ditetradecyl-3,3'-thiodipropionate, (16) dioctadecy-3,3'-thiodipropionate, (17) 1,3,5-trimethyl-2,4,6-tris(3,5-di-tert-butyl-4-hydroxybenzyl)benzene, (18) 2,6-ditert-butyl-4-(dimethylaminomethyl)phenol; and mixtures thereof.

6. The method according to claim 4 wherein said backing sheet comprises paper.

7. The method according to claim 6 wherein said anticurl agent is selected from the group consisting of (1): trimethylolpropane, (2) trimethylolpropane ethoxylate, (3) trimethylolpropane triacrylate, (4) trimethylolpropane trimethacrylate, (5) trimethylolpropane ethoxylate triacrylate, (6) trimethylolpropane propoxylate triacrylate, (7) trimethylolpropane ethoxylate methylether diacrylate, (8) trimethylolpropane tris(2-methyl-1-aziridine propionate), (9) neopentyl glycol ethoxylate, (10) neopentyl glycol propoxylate, (11) glycerol propoxylate, (12) glycerol propoxylate-b-ethoxylate triol, (13) glycerol ethoxylate-b-propoxylate triol, (14) pentaerythritol ethoxylate, (15) pentaerythritol propoxylate, (16) pentaerythrit ol propoxylate/ethoxylate, (17) triethanol amine ethoxylate, (18) N-methyl diethanolamine, (19) N-ethyl diethanolamine, (20) N-butyl diethanolamine, (21) N-phenyl diethanolamine, (22) triethanol amine, (23) tri octylamine, (24) 4-xylylene diamine, (25) 1,4-bis(2-hydroxyethoxy)-2-butyne, (26) pantothenol, (27) 1-phenyl-1,2-ethanediol, (28) 3-methoxy-1,2-propanediol, (29) 3-allyloxy-1,2-propanediol, (30) 3-ethoxy-1,2-propanediol, (31) 3-phenoxy-1,2-propanediol, (32) 3-octadecyloxy-1,2-propanediol, (33) 3-(4-methoxy phenoxy)-1,2-propane diol, (34) [3-(2-methyl phenoxy)-1,2-propanediol], (35) 3-amino-1,2-propanediol, (36) 3-(diethylamino)-1,2-propanediol, (37) 2-phenyl-1,2-propanediol, (38) 3-(diisopropyl amino)-1,2-propanediol, (39) 3-(N-benzyl-N-methylamino)-1,2-propanediol, (40) 3-pyrrolidino-1,2-propanediol, (41) 3-piperidino-1,2-propanediol, (42) 3-morpholino-1,2-propanediol, (43) 2,2-dimethyl-1-phenyl-1,3-propane diol, (44) 2-benzyloxy-1,3-propanediol, (45) 4-8-bis(hydroxymethyl) tricyclo [5.2.1.02.6] decane, (46) 1-N,N-bis(2-hydroxyethyl) isopro panolamine, (47) N,N-Bis(2-hydroxypropyl) ethanolamine, (48) 1-8 2-(2-hydroxyethoxy) ethyl]-piperazine, (49) 1-4-bis(2-hydroxyethyl) piperazine, (50) homovanillyl alcohol, (51) phenethyl alcohol, (52) 3,6-dimethyl-4-octyne-3,6-diol, (53) 2-(hydroxymethyl)-1,3-propanediol, (54) 2-butyl-2-ethyl-1,3-propanediol, (55) 2-piperidine methanol, (56) 2,2,4-trimethyl-1,3-pentanediol, (57) Vitamin E, (58) Vitamin E acetate, (59) Vitamin K, (60) tri (ethylene glycol) dimethylacrylate, (61) triethyl citrate, (62) 2,4,7,9-tetramethyl-5-decyne-4,7-diol; and mixtures thereof.

8. The method according to claim 7 wherein said liquid crystalline material is selected from the group consisting of (1) 4-(trans-4-pentyl-cyclohexyl) benzonitrile, (2) 4'-pentyl-4'-biphenylcarbo-nitrile, (3) 4'-(pentyloxy)-4-biphenylcarbonitrile, (4) 4'-hexyl-4-biphenyl carbonitrile, (5) 4'-(hexyloxy)-4-biphenyl carbonitrile, (6) 4'-heptyl-4-biphenyl carbonitrile, (7) 4'-heptyloxy-4-biphenyl carbonitrile, (8) 4'-octyl-4-biphenyl carbonitrile, (9) 4'-(octyloxy)-4-biphenyl carbonitrile, (10) 1-iso thiocyanato-4-(trans-4-propyl cyclohexyl) benzene, (11) 1-(trans-4-hexyl cyclohexyl)-4-isothiocyanato benzene, (12) 1-(4-trans-hexyl cyclohexyl)-4-[2-(4-isothio cyanatophenyl) ethyl] benzene, (13) 1-isothiocyanato-4-(trans-4-octyl cyclohexyl) benzene, (14) 4-isothiocyanato phenyl-4-pentabicyclo [2.2.2] octane-1-4-carboxylate, (Aldrich 37,005-3), (15) (R)-4-[(1-methylheptyloxy)carbonyl] phenyl 4'-octyloxy-4-biphenyl carboxylate, (16) (S)-4-[(1-methyl heptyloxy) carbonyl]phenyl-4'-octyloxy-4-biphenyl carboxylate, (17) 4-methoxy-benzylidene-4'-n-butylaniline, (18) 4,4'dihexylazoxybenzene, (19) 4,4'-diheptylazoxybenzene, (20) 4,4'-dipentyl azoxybenzene, (20) (−)2-methyl butyl-4-(4'-methoxy benzylidene-amino) cinnamate, (21) (S)-(+)-2-methylbutyl-4-(4-decyloxy benzylidene-amino) cinnamate, (22) ethyl 4-ethoxybenzal-4'amino cinnamate, (23) 2-(4-pentylphenyl)-5-(4-pentyloxyphenyl)pyrimidine, (24) 4-[(R)-(−)2-chloro-3-methylbutyryl-oxy]phenyl-4-(decyloxy)benzoate, (25) 4-[(S)-(+)2-chloro-3-methyl butyryloxy]phenyl-4-(decyloxy) benzoate, (26) 4-[(S)-(+)-(4-methyl hexyl) oxy]phenyl-4-(decyloxy) benzoate, (27) 4-[(S)-(−)-2-ethoxypropoxy] phenyl-4-(decyloxy) benzoate, (28) 4-hexylbenzoic acid, (29) cholesteryl heptanoate, (30) cholesteryl octanoate, (31) cholesteryl nonanoate, (32) cholesteryl palmitate, (33) cholesteryl palmitate, (34) cholesteryl oleyl carbonate, (35) cholesteryl stearate, (36) cholesteryl hydro cinnamate, (37) cholesteryl acetate, (38) cholesteryl chloroformate and mixtures thereof.

9. The method according to claim 8 said third coating comprises an abrasion resistant coating containing, a binder, fragrance producing compound, an antistatic agent, a fire retardant compound and filler particles.

10. The method according to claim 9 wherein said fire retardant compounds of the third coating is selected from (1)

magnesium carbonate, (2) magnesium hydroxide, (3) antimony oxide, (4) zinc borate, (5) alumina trihydrate, (6) alkoxy triacryl titanate, (7) neoalkoxy tri (N-ethylaminoethylamino) titanate, (8) neoalkoxy trineodecanoyl titanate, (9) neoalkoxy dodecylbenzene-sulfonyl titanate, (10) neoalkoxy (dioctyl phosphato) titanate, (11) semicalcined silica-alumina, (12) silicone fluid and mixtures thereof.

11. The method according to claim 10 wherein the fragrance producing material is selected form the group consisting of: (1) isoamylacetate, (2) ethyl2-methyl butyrate, (3) n-hexanal, (4) damascenone, (5) muscone, (6) ethylene brssylate, (7) ethylenedodecanedioate, 8) eremophilone, (9) anethole, (10) isobutyl-2-butenedioate, (11) 2,5-dimethyl-4-hydroxy-3(2H)-furanone, (12) carvone, (13) benzaldehyde, (14) tolylaldehyde, (15) benzylacetate, (16) 5-methyl-2-phenyl-2-hexenal, (17) iso amyl butyrate (18),vanilin, (19) isoamyl phenylacetate, (20) 2-methoxy-5-methyl pyrazine, (21) cinnamic aldehyde, (22) furfurylmercaptan, (23) furfuryl thioprop-ionate, (24) γ-nonalactone, (25) ethyloenanthate, (26) 2-methyl-2-pentenoic acid, (27) methylanthranilate, (28) ethyl3-hydroxybutyrate, (29) nootkatone, (30) methyl (methylthio) pyrazine, (31) benzylacetate, (32) indole, (33) citral, (34) α-terpineol, (35) β-sinensal, (36) ethyl anthranilate, (37) thymol, (38) octylaldehyde, (39) decyl aldehyde, (40) 2-methyl-3-92 -tolylpropionaldehyde (41) hydroxy citronellal dimethyl acetal, (42) 2,6-dimethyl-5-heptenal, (43) 2-phenylpropionaldehyde, (44) 2-methyl-3-(4-isoproylphenyl) propionaldehyde, (45) 3-methyl-1,2-cyclopentanedione, (46) menthol, (47) 3-methylthio-1-hexanol, (48) γ-undeca lactone, (49), 6-amyl-60 -pyrone, (50) 2,5-dimethylpyrazine, (51) ethyidecane-cis-4-trans-2-dienoate (52) allylcaproate (53) methyl-62 -methyl thiopropionate, (54) allyl cyclohexane propio-nate, (55) 6-methyl-60 -ionone, (56) trans-60 -ionone, (57) 4-(4-hydroxyphenyl)-2-butanone, (58) ethylmaltol, (59) methylcinnamate, (60) 4-hydroxy-2,5-dimethyl-3(2H)-furanone (61) ethylmethylphenylglycidate, (62) ethylvanilin, (63) propenyl quaethol and mixtures thereof.

12. The method according to claim 1 including providing a third coating on said backing substrate containing a fragrance producing material is selected form the group consisting of: (1) isoamylacetate, (2) ethyl2-methyl butyrate, (3) n-hexanal, (4) damascenone, (5) muscone, (6) ethylene brssylate, (7) ethylenedodecanedioate, 8) eremophilone, (9) anethole, (10) isobutyl2-butenedioate, (11) 2,5-dimethyl-4-hydroxy-3(2H)-furanone, (12) carvone, (13) benzaldehyde, (14) tolylaldehyde, (15) benzylacetate, (16) 5-methyl-2-phenyl-2-hexenal, (17) iso amyl butyrate (18),vanilin, (19) isoamyl phenylacetate, (20) 2-methoxy-5-methyl pyrazine, (21) cinnamic aldehyde, (22) furfurylmercaptan, (23) furfuryl thioprop-ionate, (24) γ-nonalactone, (25) ethyloenanthate, (26) 2-methyl-2-pentenoic acid, (27) methylanthranilate, (28) ethyl3-hydroxybutyrate, (29) nootkatone, (30) methyl (methylthio) pyrazine, (31) benzylacetate, (32) indole, (33) citral, (34) α-terpineol, (35) psinensal, (36) ethyl anthranilate, (37) thymol, (38) octylaldehyde, (39) decyl aldehyde, (40) 2-methyl-3-92 -tolylpropionaldehyde (41) hydroxy citronellal dimethyl acetal, (42) 2,6-dimethyl-5-heptenal, (43) 2-phenylpropionaldehyde, (44) 2-methyl-3-(4-isoproylphenyl) propionaldehyde, (45) 3-methyl-1,2-cyclopentanedione, (46) menthol, (47) 3-methylthio-1-hexanol, (48) γ-undeca lactone, (49), 6-amyl-60 -pyrone, (50) 2,5-dimethylpyrazine, (51) ethyidecane-cis-4-trans-2-dienoate (52) allylcaproate (53) methyl β-methyl thiopropionate, (54) allyl cyclohexane propio-nate, (55) 6-methyl-60 -ionone, (56) trans-60 -ionone, (57) 4-(4-hydroxyphenyl)-2-butanone, (58) ethylmaltol, (59) methylcinnamate, (60) 4-hydroxy-2,5-dimethyl-3(2H)-furanone (61) ethylmethylphenylglycidate, (62) ethylvanilin, (63) propenyl quaethol and mixtures thereof.

13. The method according to claim 12 wherein said third coating further comprises a fire retardant material.

14. The method according to claim 3 wherein said fragrance producing material is selected from the group consisting of: (1) isoamylacetate, (2) ethyl2-methyl butyrate, (3) n-hexanal, (10) isobutyl, 2-butenedioate, (11) 2,5-dimethyl-4-hydroxy-3(2H)-furanone, (12) carvone, (13) benzaldehyde, (14) tolylaldehyde, (15) benzylacetate, (16) 5-methyl-2-phenyl-2-hexenal, (17) iso amyl butyrate (18), vanilin, (19) isoamyl phenylacetate, (20) 2-methoxy-5-methyl pyrazine, (21) cinnamic aldehyde, (22) furfurylmercaptan, (23) furfuryl thioprop-ionate, (24) γ-nonalactone, (25) ethyloenanthate, (26) 2-methyl-2-pentenoic acid, (27) methylanthranilate, (28) ethyl3-hydroxybutyrate, (29) nootkatone, (30) methyl (methylthio) pyrazine, (31) benzylacetate, (32) indole, (33) citral, (34) α-terpineol, (35) β-psinensal, (36) ethyl anthranilate, (37) thymol, (38) octylaldehyde, (39) decyl aldehyde, (40) 2-methyl-3-92 -tolylpropionaldehyde (41) hydroxy citronellal dimethyl acetal, (42) 2,6-dimethyl-5-heptenal, (43) 2-phenylpropionaldehyde, (44) 2-methyl-3-(4-isoproylphenyl) propionaldehyde, (45) 3-methyl-1,2-cyclopentanedione, (46) menthol, (47) 3-methylthio-1-hexanol, (48) γ-undeca lactone, (49), 6-amyl-60 -pyrone, (50) 2,5-dimethylpyrazine, (51) ethyldecane-cis-4-trans-2-dienoate (52) allylcaproate (53) methyl β-methyl thiopropionate, (54) allyl cyclohexane propio-nate, (55) 6-methyl-60 -ionone, (56) trans-60 -ionone, (57) 4-(4-hydroxyphenyl)-2-butanone, (58) ethylmaltol, (59) methylcinnamate, (60) 4-hydroxy-2,5-dimethyl-3(2H)-furanone (61) ethylmethylphenylglycidate, (62) ethylvanilin, (63) propenyl quaethol and mixtures thereof.

15. The method according to claim 12 wherein said third coating is applied to another surface of said backing substrate.

16. The method according to claim 15 wherein said third coating is applied to another surface of said backing substrate.

17. The method according to claim 2 wherein said material having multiple thermal transitions comprises a liquid crystalline material.

18. The method according to claim 3 wherein said material having multiple thermal transitions comprises a liquid crystalline material.

19. The method according to claim 3 wherein said step of providing an opaque backing substrate comprises selecting a backing substrate from the group consisting of (1) Offset papers, (2) copying papers, (3) inkjet papers, (4) Diazo papers, (5) Teslin, (6) coated photographic papers., and (7) opaque Mylar.

20. The method according to claim 19 wherein said fragrance producing material is selected from the group consisting of: (1) isoamylacetate, (2) ethyl2-methyl butyrate, (3) nhexanal, (4) damascenone, (5) muscone, (6) ethylene brssylate, (7) ethylenedodecanedioate, (8) eremophilone, (9) anethole, (10) isobutyl2-butenedioate, (11) 2,5-dimethyl-4-hydroxy3(2H)-furanone, (12) carvone, (13) benzaldehyde, (14) tolylaldehyde, (15) benzylacetate, (16) 5-methyl-2-phenyl-2-hexenal, (17) iso amyl butyrate (18),vanilin, (19) isoamyl phenylacetate, (20) 2-methoxy-5-methyl pyrazine, (21) cinnamic aldehyde, (22)

furfurylmercaptan, (23) furfuryl thioprop-ionate, (24) γ-nonalactone, (25) ethyloenanthate, (26) 2-methyl-2-pentenoic acid, (27) methylanthranilate, (28) ethyl3-hydroxybutyrate, (29) nootkatone, (30) methyl (methylthio) pyrazine, (31) benzylacetate, (32) indole, (33) citral, (34) α-terpineol, (35) β-sinensal, (36) ethyl anthranilate, (37) thymol, (38) octylaldehyde, (39) decyl aldehyde, (40) 2-methyl-3-92 -tolylpropionaldehyde (41) hydroxy citronellal dimethyl acetal, (42) 2,6-dimethyl-5-heptenal, (43) 2-phenylpropionaldehyde, (44) 2-methyl-3-(4-isoproylphenyl) propionaldehyde, (45) 3-methyl-1,2-cyclopentanedione, (46) menthol, (47) 3-methylthio-1-hexanol, (48) γ-undeca lactone, (49), 6-amyl-60 -pyrone, (50) 2,5-dimethylpyrazine, (51) ethyldecane-cis-4-trans-2-dienoate (52) allylcaproate (53) methyl β-methyl thiopropionate, (54) allyl cyclohexane propio-nate, (55) 6-methyl-60 -ionone, (56) trans-60 -ionone, (57) 4-(4-hydroxyphenyl)-2-butanone, (58) ethylmaltol, (59) methylcinnamate, (60) 4-hydroxy-2,5-dimethyl-3(2H)-furanone (61) ethylmethylphenylglycidate, (62) ethylvanilin, (63) propenyl quaethol and mixtures thereof.

* * * * *